US008584858B2

(12) United States Patent
Golias

(10) Patent No.: US 8,584,858 B2
(45) Date of Patent: Nov. 19, 2013

(54) PACKING REINFORCEMENT MEMBER

(75) Inventor: Robert J. Golias, Solon, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 0 days.

(21) Appl. No.: 13/116,177

(22) Filed: May 26, 2011

(65) Prior Publication Data

US 2011/0290699 A1 Dec. 1, 2011

Related U.S. Application Data

(60) Provisional application No. 61/349,487, filed on May 28, 2010.

(51) Int. Cl.
*B65D 81/02* (2006.01)
*B65D 85/30* (2006.01)

(52) U.S. Cl.
USPC ..... 206/586; 206/320; 206/453

(58) Field of Classification Search
USPC ..... 206/320, 453, 586, 591
See application file for complete search history.

(56) References Cited

U.S. PATENT DOCUMENTS

| | | | | | |
|---|---|---|---|---|---|
| 3,129,868 | A | * | 4/1964 | Jenk | 206/586 |
| 3,244,347 | A | * | 4/1966 | Jenk | 206/586 |
| 3,344,916 | A | * | 10/1967 | Brueckner | 206/453 |
| 3,650,459 | A | * | 3/1972 | Tucker | 206/591 |
| 3,762,626 | A | | 10/1973 | Dorsey | |
| 3,854,579 | A | * | 12/1974 | Scharre | 206/320 |
| 3,921,279 | A | * | 11/1975 | Daley | 206/320 |

* cited by examiner

*Primary Examiner* — Bryon Gehman
(74) *Attorney, Agent, or Firm* — Fay Sharpe LLP; James E. Scarbrough

(57) ABSTRACT

A packing reinforcement member has an elongated body having a first end and a second end. A first side wall extends between the first end and the second end. The first side wall has an inner wall portion and an outer wall portion. A second side wall and a third side wall are connected to each other at an angle and both extend from the first side wall. A packing assembly for shipping and storage of objects has a shipping container including a plurality of side walls and a bottom wall extending between the plurality of side walls. At least one packing reinforcement member is positioned adjacent a corner of the shipping container formed by two of the plurality of side walls.

17 Claims, 5 Drawing Sheets

PACKING REINFORCEMENT MEMBER

CLAIM OF PRIORITY

This application claims priority from Provisional Patent Application Ser. No. 61/349,487 which was filed on May 28, 2010 which is hereby incorporated by reference.

BACKGROUND OF THE DISCLOSURE

The disclosure relates to packing members. More particularly, it relates to a packing reinforcement member which may be used in shipping containers or boxes for metal cabinets, shelves, drawers, etc. or any object to be shipped. Specifically, the packing members may be used in corners of shipping boxes or containers to provide reinforcement and rigidity and to prevent crushing.

Protecting members are frequently used between shipping cartons and an object being shipped in the carton. These protecting members are often required by shipping regulations such as by the United Parcel Service (UPS). For example, molded paper pulp corner protectors have been used for spacing an object such as a piece of furniture from the corners of the shipping carton. The corner protectors are designed to absorb shock while at the same time reasonably securely positioning the item of furniture or other object within the carton. Some corner protectors include concavely dished or centrally pinched side walls adapted for engaging the furniture corner within the triangular form of the corner protector. Other corner protectors have side walls with plural indentations extending upwardly from the base of the protector for some short or intermediate distance. A problem with these devices is they fail to provide adequate protection for the object being shipped because of a lack of firmness, heaviness, or resistance to crushing on the part of the protector, and also because the prior protectors have had insufficient general thickness to protect the object being shipped from sharp blows, shocks from falls, vertical loads, and the like. Some protectors lack the desired cushioning or resilience as well as the adaptability of conformity to the shipped object.

Accordingly, there is a need for corner or side packing reinforcement members which are bendable or flexible but also rigid and sturdy enough to withstand lateral and vertically applied forces.

SUMMARY OF THE DISCLOSURE

The disclosure relates to packing members. More particularly, it relates to a corner or side packing reinforcement member which cushions an object to be shipped from lateral or side forces as well as vertical or longitudinal forces being applied to the object being shipped and the packing container the object is contained within. The present disclosure provides advantageous engagement, cushioning, and protection of the cabinet or object being shipped while at the same time maintaining article strength and resistance to crushing. The disclosure not only provides greater physical protection of the object being shipped, but also supplies greater strength as a consequence of its column configuration.

According to one aspect of the disclosure, a packing reinforcement member includes an elongated body having a first end and a second end; and a first side wall extending between the first end and the second end. The first side wall has an inner wall portion and an outer wall portion. A second side wall and a third side wall are connected to each other at an angle and both extend from the first side wall.

According to another aspect of the disclosure, a packing assembly for shipping and storage of objects includes a shipping container having a plurality of side walls and a bottom wall extending between the plurality of side walls. At least one packing reinforcement member is positioned adjacent a corner of the shipping container formed by two of the plurality of side walls. The packing reinforcement member has an elongated body having a first end and a second end. A first side wall extends between the first end and the second end. A second side wall and a third side wall are connected to each other at an angle and both extend from the first side wall.

It is accordingly an object of the present disclosure to provide an improved protector for use in shipping cartons and the like.

It is a further object of the present disclosure to provide an improved corner protector or reinforcement member for use in shipping cartons and the like wherein such protector provides enhanced protection and resilient cushioning of the object being shipped while at the same time preserving strength against vertical loads or lateral side loads or crushing or inadequate support of the shipped article.

It is a further object of the present disclosure to provide an improved corner protector for use in shipping, affording improved overall corner covering and protection of the article being shipped while being economical in material, shipping space, and manufacturing space.

It is another object of the disclosure to provide a reinforcement member made from cardboard, foam or any suitable bendable or flexible but rigid material.

Still another object of the disclosure is to provide a reinforcement member which is foam filled to provide additional absorption capability.

It is still another object of the disclosure to provide notches in the reinforcement member to facilitate bending and installation of the reinforcement member in a shipping box.

Still other objects of the disclosure will become apparent upon a reading and understanding of the following detailed description.

DETAILED DESCRIPTION OF THE DISCLOSURE

Figure 1:
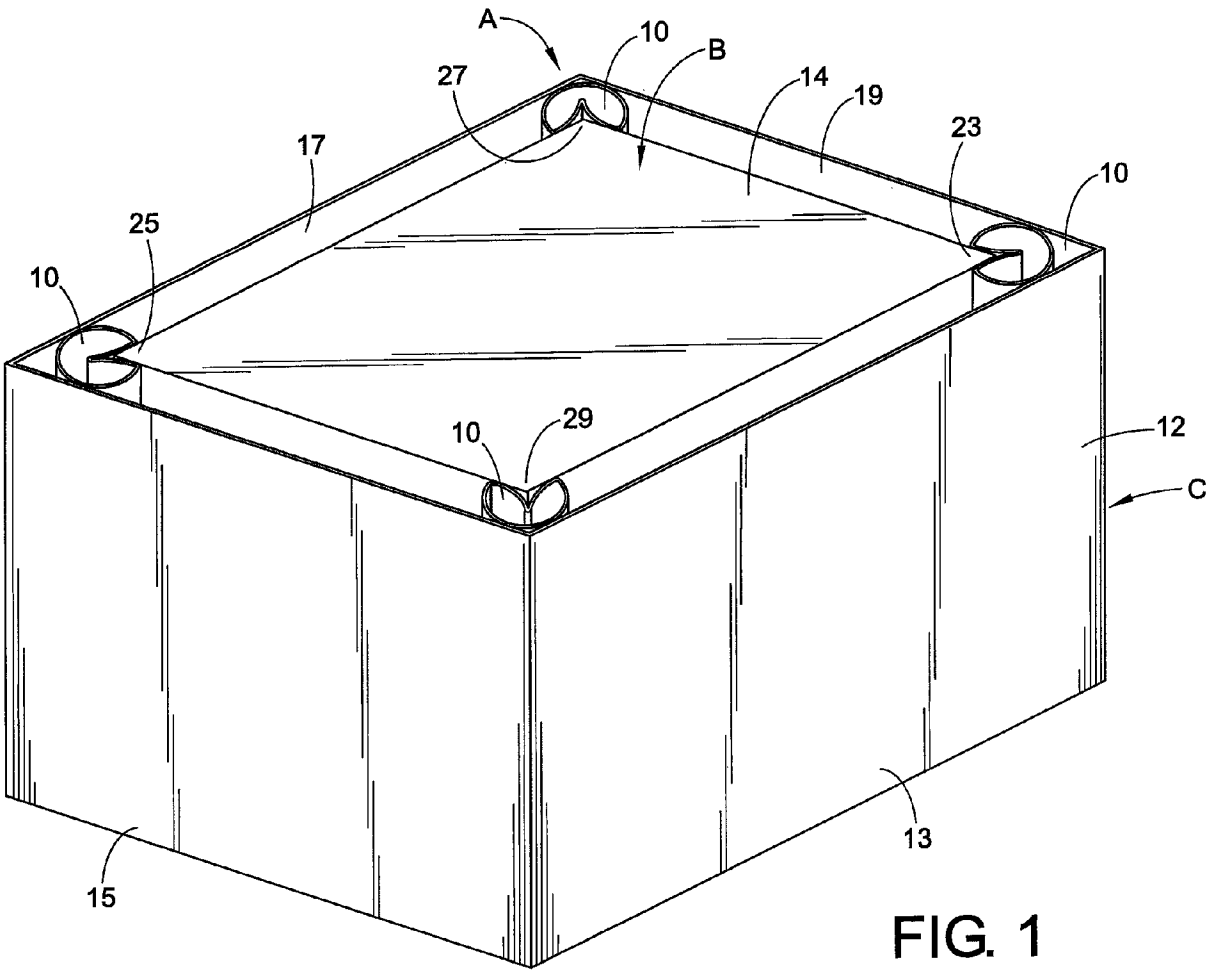
FIG. 1 is a perspective view of the corner reinforcement members in a shipping container in accordance with a preferred embodiment of the present disclosure.

Referring to the drawings and particularly to FIGS. 1 through 10, a corner protector A according to the present invention is preferably formed from cardboard or bendable plastic or molded pulp in one piece. The protector can also be made of rigid but flexible foam. The protector is preferably bendable but rigid enough to withstand various vertical and/or lateral side loads or forces applied to the container as well as the corner protector.

Figure 2:
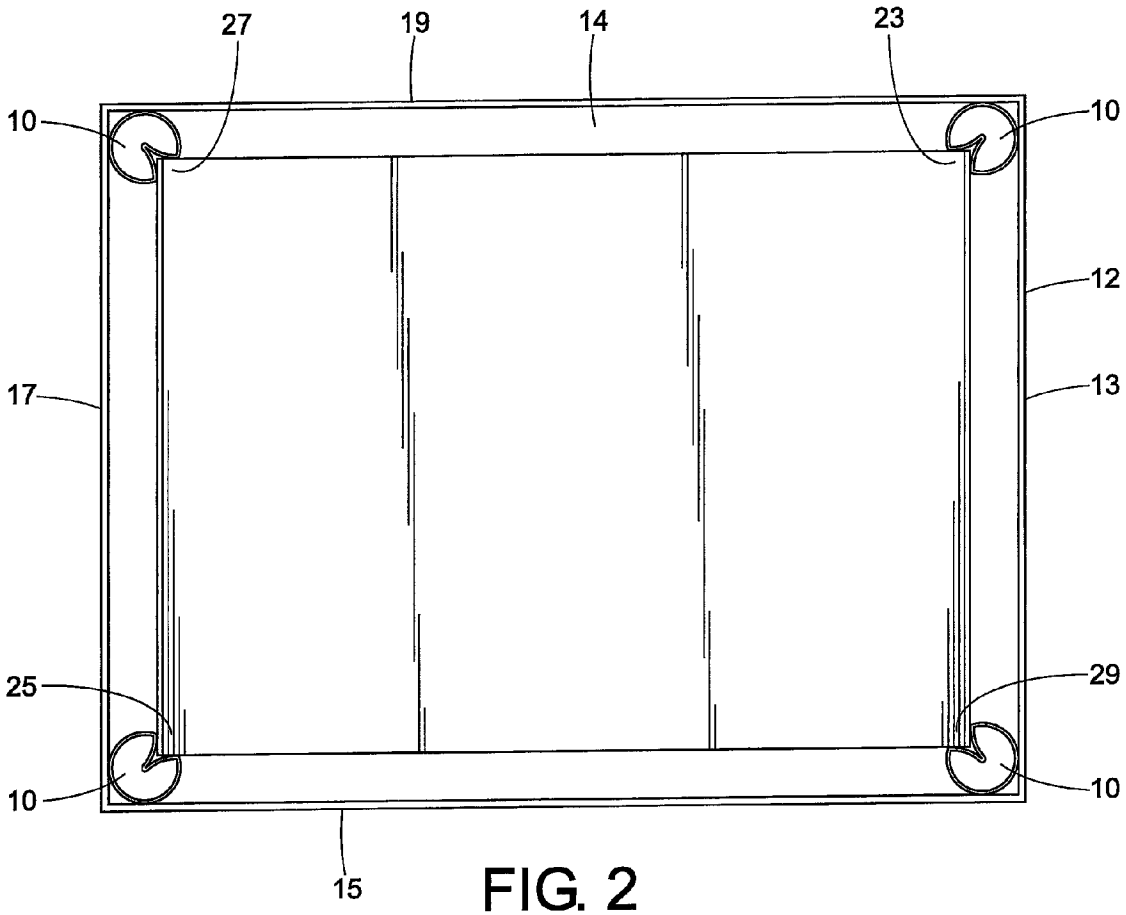
FIG. 2 is a top plan view of the corner protector and shipping container of FIG. 1.

The utilization of the protector member according to the present disclosure is illustrated in FIGS. 1 and 2, wherein a metal cabinet B or other object to be shipped is disposed inside a shipping container C such as a cardboard box. The member according to the present disclosure protects the cabinet or other object while holding the same securely within the packing container or carton.

Referring now to FIG. 1, corner packing reinforcement members 10 are shown installed on four corners of a shipping carton or box 12. A metal cabinet 14 or object to be shipped is centrally positioned within the box 12. The metal cabinet may be a bin with shelves, or drawers, or doors. The box is preferably a cardboard shipping box. The box may have various thicknesses. However, other materials suitable for storage or shipping may also be used. The reinforcement member 10 is substantially the same height or slightly taller than side walls 13, 15, 17, 19 of the box so that the member can absorb vertical loads or forces as well as lateral or side forces applied to the box.

FIG. 2 is a top plan view of the shipping box and cabinet box assembly of FIG. 1. The four corner packing reinforcement members 10 are positioned so that members are on opposed diagonal ends and oppose each other. The members 10 are shown only at the four corners, however, the protectors can be placed along the walls of the box as well. Also, the members 10 may only be placed at two opposite corners.

Figure 9:
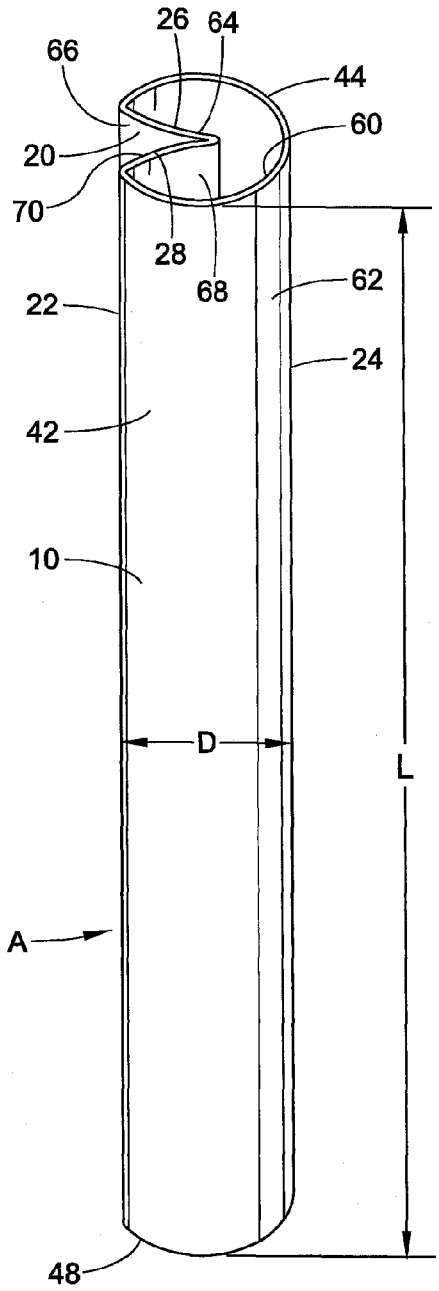
FIG. 9 is a perspective view of a corner reinforcement member in accordance with the disclosure.

Referring to FIG. 9, each corner reinforcement member 10 has an elongated body 42 having a first end 44 and a second end 48 and a first side wall 22 extending the longitudinal length of the body between the first end and the second end. First side wall 22 has an inner wall portion 60 and an outer wall portion 62. Each member has a recess or groove 20 formed centrally on one side or wall 22 of the member. The groove also extends along the longitudinal length of the member. Each member is substantially cylindrical or tubular in shape except for the recess or groove portion.

Referring to FIGS. 1 and 2, each recess or groove is configured to receive one of corners 23, 25, 27, 29 of a metal cabinet or other object to be shipped.

Referring again to FIG. 9, the recess or groove 20 can have two curved or arcuate or angled walls 26, 28 which form a generally pie-shaped recess in the member. Second side wall 26 also has an inner wall portion 64 and an outer wall portion 66. Third side wall 28 has an inner wall portion 68 and an outer wall portion 70.

Figure 3:
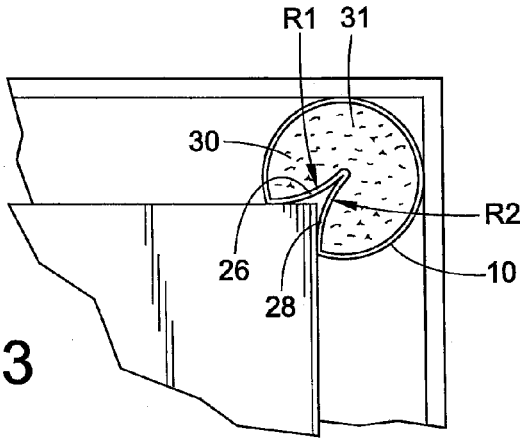
FIG. 3 is an enlarged corner view of a shipping container showing a corner reinforcement member without any side loads being applied.
Figure 10:
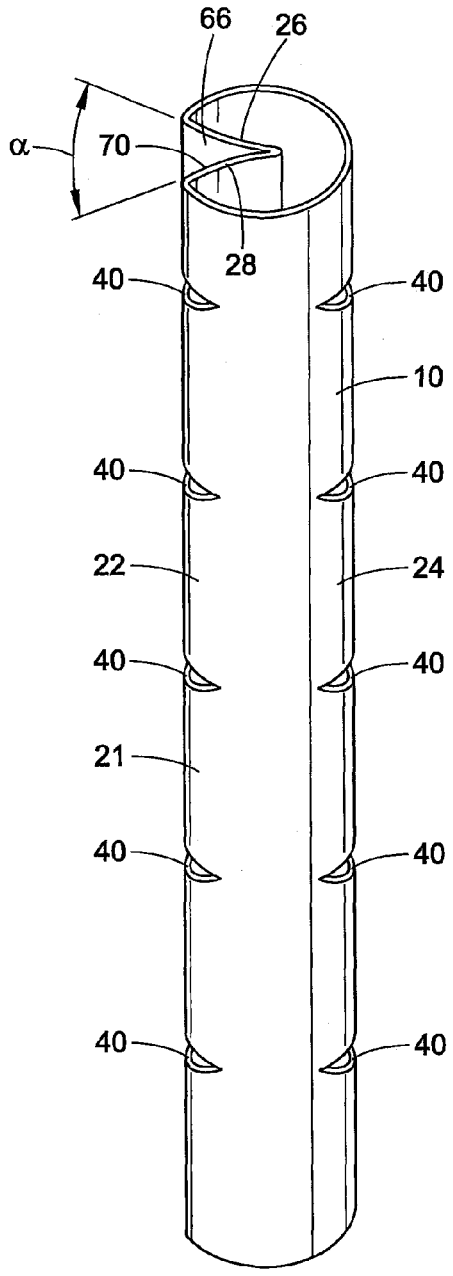
FIG. 10 is a perspective view of a corner reinforcement member in accordance with another aspect of the disclosure.

Referring to FIG. 10, an angle $\alpha$ is formed between the second and third side walls. Angle $\alpha$ is an acute angle and can range from about 30 degrees to 45 degrees or more or any suitable angle. The angle $\alpha$ of the recess 20 extends along the longitudinal length of the wall 22 of the member. As best seen in FIG. 3, walls 26 and 28 can have a radius R1 and R2, respectively, which can vary in dimension anywhere from 0.20 inches to 0.50 inches, or any suitable radius. Walls 26 and 28 can also be fairly straight with only a slight curvature.

In accordance with one embodiment, the member is substantially hollow and has walls of various thicknesses. The thickness of the member walls can vary, such as 1/16 inches thick or more on any other suitable thicknesses. The member can be formed of cardboard or any other bendable but sturdy material capable of absorbing lateral and vertical loads, such as sturdy foam. As another alternative, the cardboard member can be resin-coated with any suitable alcohol based resin to provide additional rigidity to the member. The member can be of any suitable length L, such as 12 or 13 inches, 32 inches, or any interior depth for a typical shipping box or carton. The tube or member can also have various diameters D such as 1 inch, 2 inches, or any other suitable diameter sizes.

Alternatively, such as shown in FIG. 3, the member can have foam 31 such as polyurethane or any suitable foam material injected into interior cavity 30 of the member formed by inner wall portions 60, 64, 68 with the foam substantially filling the cavity.

Referring again to FIG. 3, the member 10 is shown in an unloaded or uncompressed state. Alternatively, FIG. 3 can represent a member absorbing a vertical load extending into the page of FIG. 3.

Figure 4:
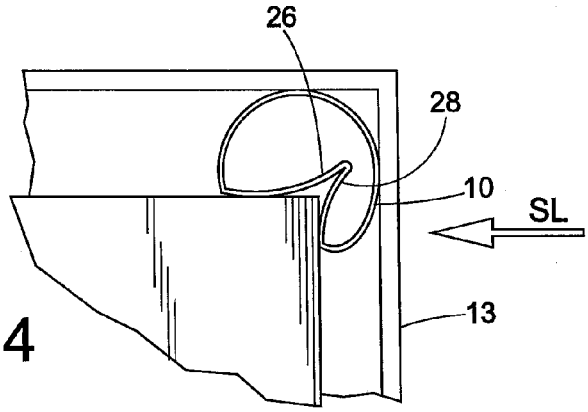
FIG. 4 is an enlarged corner view of a shipping container showing a lateral or side load being applied to the corner reinforcement member.

Referring now to FIG. 4, a lateral or side load SL (shown by the arrow in FIG. 4) is applied substantially perpendicular to side wall 13 of the shipping box. The member 10 will absorb the load by deforming wall 28 toward side wall 13 while stretching wall 26 of member 10. Thus, protector 10 absorbs the load rather than the object being shipped. When the load is removed, the protector will eventually return to its original, uncompressed state.

Figure 5:
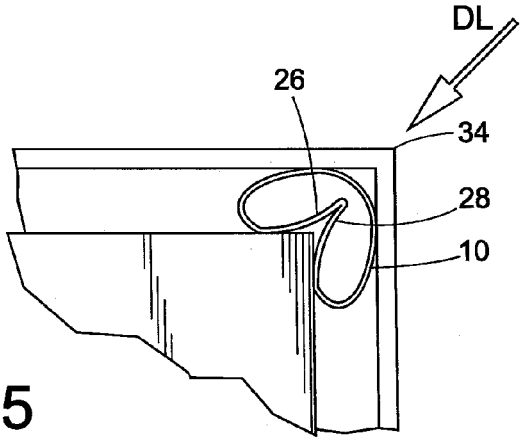
FIG. 5 is an enlarged corner view of a shipping container showing a diagonal or side load being applied to a corner reinforcement member.

Referring now to FIG. 5, a diagonal lateral load DL (shown by the arrow in FIG. 5) is shown being applied to a corner 34 of the shipping box. Both walls 26, 28 of the member are flexed and are deformed and pushed toward corner 34, and absorb a substantial portion of the diagonal load DL. When the load is removed, the walls 26, 28 will eventually return to their original, uncompressed state.

In each of these scenarios, the vertical or lateral forces or loads are absorbed by the corner members, thus protecting the corners of the metal cabinet and preventing any loads from damaging the cabinet. The corner members are designed to absorb the loads, which are based on typical shipping loads known in the shipping industry.

Referring to FIG. 10, in an alternate embodiment, notches or grooves 40 are formed along a length of the corner member on either the front area 21 or back area 24 of the member wall 22, or both.

The notches 40 can be generally triangular in shape and serve to facilitate bending of the member, such as for ease of installing the member in a corner of the shipping carton after the metal cabinet is already in place in the carton. The notches can be evenly or unevenly spaced along the longitudinal length of the member.

Figure 8:
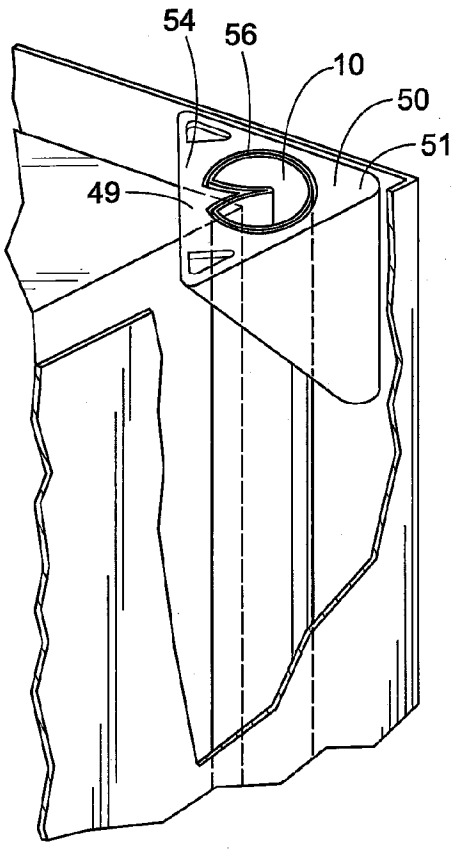
FIG. 8 is a partial embodiment of a corner reinforcement member used with a triangle-shaped corner protector with a cut-out in accordance with another alternate embodiment of the disclosure.
Figure 7:
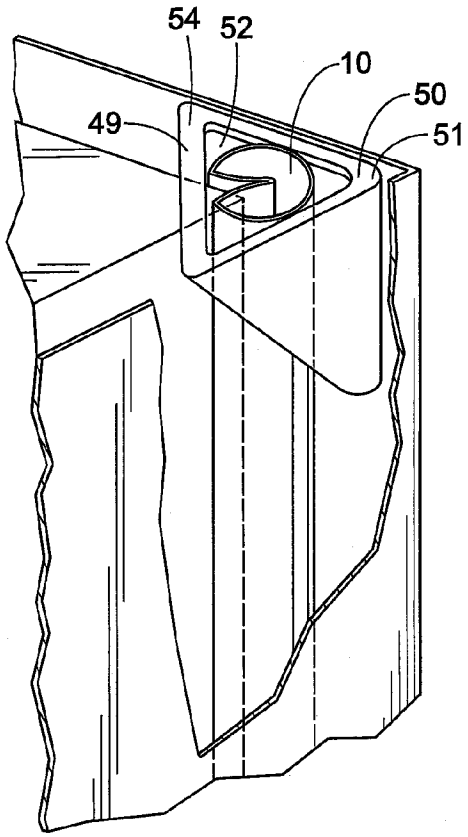
FIG. 7 is a partial perspective view of another alternate embodiment of a corner reinforcement member used with a triangle-shaped corner protector having a cut-out therein.
Figure 6:
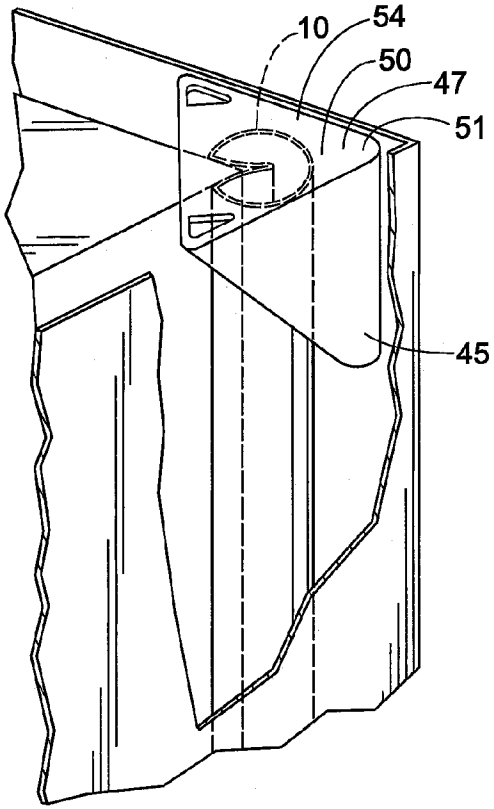
FIG. 6 is a partial perspective view of an alternate embodiment of a corner reinforcement member used with a triangle-shaped corner protector.

Referring now to FIGS. 6, 7 and 8, the packing member can be used in combination with another corner protector 50 which includes a molded pulp protector such as shown and described in U.S. Pat. No. 3,762,626, which is hereby incorporated by reference.

The corner protector 50 includes three mutually perpendicular sides 45, 47, and top wall 54. Each of the sides is substantially triangular in shape and form an apex 51 at the juncture of the walls. The apex 51 corresponds to and mates with a corner of the object to be shipped as seen in FIGS. 6, 7, and 8

Referring to FIG. 6, the corner protector 50 is inserted over the top of the member 10 to provide additional reinforcement vertically and on side edges of the corner of the shipping box.

Referring to FIG. 7, a triangular-shaped cut-out 52 is formed in a top wall 54 of the protector 50 to allow member 10 to extend through the top wall 54 of protector 50.

Referring to FIG. 8, a cut-out 56 is formed in top wall 54 of the protector 50 in substantially the same shape as the member 10 to allow the member 10 to extend through the protector cut-out 56 and provide lateral support to the upper end of the member.

The exemplary embodiment has been described with reference to the preferred embodiments. Obviously, modifications and alterations will occur to others upon reading and understanding the preceding detailed description. It is intended that the exemplary embodiment be construed as including all such modifications and alterations.

The invention claimed is:

1. A packing reinforcement member, comprising:

an elongated body having a first end and a second end;

a first side wall defining a perimeter extending between said first end and said second end; wherein said first side wall comprises a plurality of spaced notches extending along a longitudinal length of said first side wall, wherein various of said notches are oppositely disposed on the perimeter of said first side wall;

said first side wall comprising an inner wall portion and an outer wail portion;

a second side wall and a third side wall integrally connected to each other and forming an angle therebetween and both said second side wall and said third side wall extending from said first side wall; wherein said second side wall comprises a radius consisting of a single continuous radius extending from said first side wall to said third side wall and said third side wall comprises a radius consisting of a single continuous radius extending from said second side wall to said first side wall.

2. The packing reinforcement member of claim 1, wherein said second, side wall comprises an inner wall portion and an outer wall portion.

3. The packing reinforcement member of claim 1, wherein said third side wall comprises an inner wall portion and an outer wall portion.

4. The packing reinforcement member of claim 1, wherein said second and third side walls are curved toward each other.

5. The packing reinforcement member of claim 1, wherein said angle is an acute angle.

6. The packing reinforcement member of claim 1, wherein said elongated body has a length in the range of 13 to 32 inches.

7. The packing reinforcement member of claim 1, wherein said first side wall has a thickness of about 1/16 inch.

8. The packing reinforcement member of claim 1, wherein said second and third side walls each has a thickness of about 1/16 inch.

9. The packing reinforcement member of claim 1, wherein said elongated body has an outer diameter of about 1 inch.

10. The packing reinforcement member of claim 1, wherein said member is formed of cardboard.

11. The packing reinforcement member of claim 1, wherein said member is made from foam.

12. A packing assembly for shipping and storage of objects, comprising:

a shipping container comprising a plurality of side walls and a bottom wall extending between said plurality of side walls;

at least one packing reinforcement member positioned adjacent a corner of said shipping container formed by two of said plurality of side walls; said at least one packing reinforcement member comprising:

an elongated body defining a perimeter and having a first end and a second end, wherein a plurality of substantially triangular shaped spaced notches are formed extending along said elongated body and wherein various of said notches are oppositely disposed on the perimeter of said elongated body;

a first side wall extending between said first end and said second end;

a second side wall and a third side wall integrally connected to each other forming an angle therebetween and both said second side wall and said third side wall extending from said first side wall, wherein said second side wall comprises only a single continuous radius extending between a first end of said second side wall connected to said first side wall and a second end of second side wall connected to said third side wall and said third side wall comprises only a single continuous radius extending between a first end of said third side wall connected to said first side wall and a second end of said third side wall connected to said second side wall.

13. The packing assembly of claim 12, wherein said first side wall comprises an inner wall portion and an outer wall portion.

14. The packing assembly of claim 12, wherein said second side wall comprises an inner wall portion and an outer wall portion.

15. The packing assembly of claim 12, wherein said third side wall comprises an inner wall portion and an outer wall portion.

16. The packing assembly of claim 12, wherein said second and third side walls are curved toward each other.

17. The packing assembly of claim 12, wherein said angle is an acute angle.

* * * * *